US010660455B2

(12) United States Patent
Cheng

(10) Patent No.: US 10,660,455 B2
(45) Date of Patent: May 26, 2020

(54) BABY CARRIER

(71) Applicant: Wonderland Switzerland AG, Steinhausen (CH)

(72) Inventor: Manqun Cheng, Guangdong (CN)

(73) Assignee: Wonderland Switzerland AG, Steinhausen (CH)

( * ) Notice: Subject to any disclaimer, the term of this patent is extended or adjusted under 35 U.S.C. 154(b) by 0 days.

(21) Appl. No.: 16/128,530

(22) Filed: Sep. 12, 2018

(65) Prior Publication Data

US 2019/0075938 A1 Mar. 14, 2019

(30) Foreign Application Priority Data

Sep. 12, 2017 (CN) ..... 2017 1 0818673

(51) Int. Cl.
*A47D 13/02* (2006.01)

(52) U.S. Cl.
CPC ..... *A47D 13/025* (2013.01); *A47D 13/02* (2013.01)

(58) Field of Classification Search
CPC ..... A47D 13/025; A47D 13/02
USPC ..... 224/160
See application file for complete search history.

(56) References Cited

U.S. PATENT DOCUMENTS 4,402,440 A * 9/1983 Purtzer ..... A47D 13/025 224/159
5,246,152 A * 9/1993 Dotseth ..... A47D 13/025 224/158
5,490,620 A * 2/1996 Bergqvist ..... A47D 13/025 224/160
5,522,528 A * 6/1996 Petricola ..... A47D 13/025 224/160
5,641,101 A * 6/1997 Nakayama ..... A47D 13/025 224/159
5,678,739 A * 10/1997 Darling ..... A47D 13/025 224/158
5,685,466 A * 11/1997 Hsieh ..... A47D 13/025 224/159
6,179,175 B1 * 1/2001 Painter ..... A45F 3/08 224/153
6,421,852 B1 * 7/2002 Shao ..... A63H 3/005 446/73

(Continued)

FOREIGN PATENT DOCUMENTS

CN 204260362 U 4/2015
JP 2003-225119 A 8/2003
JP 2016-54897 A 4/2016

*Primary Examiner* — Nathan J Newhouse
*Assistant Examiner* — Lester L Vanterpool
(74) *Attorney, Agent, or Firm* — Winston Hsu

(57) ABSTRACT

The present invention discloses a baby carrier including a back strap and a vest. The back strap includes at least one first connecting component and at least one second connecting component. The vest includes a vest body, at least one third connecting component and at least one fourth connecting component. The at least one third connecting component and the at least one fourth connecting component respectively are fixed on two ends of the vest body. The at least one third connecting component and the at least one fourth connecting component respectively are detachably connected to the at least one first connecting component and the at least one second connecting component to connect the back strap with the vest. It provides a flexible way for a caregiver to carry a baby comfortably and safely.

19 Claims, 15 Drawing Sheets

(56) References Cited

U.S. PATENT DOCUMENTS

| | | | | |
|---|---|---|---|---|
| 7,818,842 | B2 * | 10/2010 | Marciano | A47C 17/64<br>441/131 |
| 8,028,871 | B2 * | 10/2011 | Gray | A47D 15/006<br>224/158 |
| 9,877,595 | B2 * | 1/2018 | Wang | A47D 13/025 |
| 2002/0078501 | A1 * | 6/2002 | Lamke | A47G 9/086<br>5/413 AM |
| 2004/0149790 | A1 * | 8/2004 | Kassai | A47D 13/02<br>224/160 |
| 2005/0045674 | A1 * | 3/2005 | Rehbein | A47D 13/025<br>224/160 |
| 2007/0061965 | A1 * | 3/2007 | Crawford | A47G 9/066<br>5/413 R |
| 2009/0026235 | A1 * | 1/2009 | Gray | A47D 13/025<br>224/160 |

* cited by examiner

110"

BABY CARRIER

BACKGROUND OF THE INVENTION

1. Field of the Invention

The present invention relates to a child product, and more particularly, to a baby carrier which can provide a flexible way to carry a baby comfortably and safely.

2. Description of the Prior Art

A baby carrier allows a caregiver to keep his/her hands free to interact with a baby when carrying a baby outside. There are different types of baby carriers. For example, the baby carriers can be classified into horizontal baby carriers, front-facing baby carriers, face-to-face baby carriers or backpack baby carriers by using methods. Furthermore, the baby carriers also can be classified into single-purpose baby carriers, dual-purpose baby carriers or triple-purpose baby carriers by functions.

The baby carrier needs to be designed in accordance with ergonomics for reducing the caregiver's burden. Furthermore, the baby carrier has to be capable of providing support for a hip, a waist, a neck and a head of the baby for preventing bending, twisting and unnecessary stress to provide comfort and safety for the baby, which protects muscles and bones of the baby. However, the conventional baby carrier is suitable for only an older baby, who is a few month of age, but not suitable for a newborn baby, who has very soft muscles and bones, because the conventional baby carrier cannot provide enough support for the newborn baby.

Therefore, there is still a need to provide a baby carrier which can provide a flexibly way to carry a baby of different ages comfortably and safely for solving the aforementioned problems.

SUMMARY OF THE INVENTION

It is an objective to provide a baby carrier which can provide a flexibly way to carry a baby of different ages comfortably and safely for solving the aforementioned problems.

In order to achieve the aforementioned objective, the present invention discloses a baby carrier for carrying a baby. The baby carrier includes a back strap and a vest. The back strap includes at least one first connecting component and at least one second connecting component. The vest includes a vest body, at least one third connecting component and at least one fourth connecting component. The at least one third connecting component and the at least one fourth connecting component are respectively fixed on two ends of the vest body. The at least one third connecting component is detachably connected to the at least one first connecting component, and the at least one fourth connecting component is detachably connected to the at least one second connecting component.

Preferably, the back strap further includes a waist belt and two shoulder straps connected to the waist belt. The at least one first connecting component is disposed on at least one of the two shoulder straps, and the at least one second connecting component is disposed on the waist belt.

Preferably, the back strap further includes a hip seat connected to the waist belt and for supporting the baby.

Preferably, the hip seat includes an accommodating bag and a seat core accommodated inside the accommodating bag.

Preferably, the back strap further includes a receiving bag disposed on the waist belt.

Preferably, the vest further includes a first fixing component. An end of the first fixing component is connected to one of the two ends of the vest body, and another end of the first fixing component is detachably connected to the vest body for fixing the baby.

Preferably, the vest further includes at least one fifth connecting component disposed on the first fixing component and at least one sixth connecting component disposed on the vest body, and the at least one fifth connecting component is detachably connected to the at least one sixth connecting component.

In order to achieve the aforementioned objective, the present invention further discloses a baby carrier for carrying a baby. The baby carrier includes a sleeping bag, a back strap and a vest. The back strap includes at least one first connecting component and at least one second connecting component. The vest includes a vest body, at least one third connecting component and at least one fourth connecting component. The at least one third connecting component and the at least one fourth connecting component are respectively fixed on two ends of the vest body. The at least one third connecting component is detachably connected to the at least one first connecting component, and the at least one fourth connecting component is for detachably connecting the sleeping bag to the vest or detachably connecting the vest to the back strap.

Preferably, the vest further includes at least one fifth connecting component disposed on the vest body and located between the at least one third connecting component and the at least one fourth connecting component. The at least one fifth connecting component passes through the sleeping bag to be detachably connected to the at least one second connecting component, and the at least one fourth connecting component passes through the sleeping bag to be detachably connected to the vest body.

Preferably, the vest further includes at least one sixth connecting component disposed on the vest body and located between the at least one third connecting component and the at least one fifth connecting component, and the at least one fifth connecting component is detachably connected to the at least one sixth connecting component.

Preferably, the sleeping bag includes a supporting body, at least one first fixing ring and at least one second fixing ring. The at least one first fixing ring and the at least one second fixing ring are symmetrically disposed on a rear side of the supporting body. The at least one fourth connecting component passes through the at least one first fixing ring, and the at least one fifth connecting component passes through the at least one second fixing ring.

Preferably, the vest further includes a first fixing component connected to an end of the vest body, and the at least one fifth connecting component is fixed on an end of the first fixing component away from the vest body.

Preferably, the back strap further includes at least one seventh connecting component. The sleeping bag includes at least one eighth connecting component corresponding to the at least one seventh connecting component. The vest body is for supporting the sleeping bag. The at least one seventh connecting component is detachably connected to the at least one eighth connecting component to connect the sleeping bag to the back strap, and the at least one fourth connecting component is detachably connected to the at least one second connecting component to connect the vest to the back strap.

Preferably, the at least one third connecting component and the at least one fourth connecting component are respectively disposed on two ends of the vest body and arranged along a longitudinal direction of the vest body, and the longitudinal direction of the vest body is substantially perpendicular to a longitudinal direction of the sleeping bag.

Preferably, the sleeping bag includes a supporting body and a surrounding border disposed on a periphery of the supporting body.

Preferably, the sleeping bag further includes a second fixing component detachably connected to an end of the supporting body and for fixing the baby.

Preferably, the sleeping bag further includes a fixing strap movably passing through the second fixing component, and at least one end of the fixing strap is detachably connected to the supporting body or the surrounding border.

Preferably, the back strap further includes a waist belt and two shoulder straps connected to the waist belt. The at least one first connecting component is disposed on at least one of the two shoulder straps, and the at least one second connecting component is disposed on the waist belt.

Preferably, the back strap further includes a hip seat connected to the waist belt and for supporting the baby.

Preferably, the hip seat includes an accommodating bag and a seat core accommodated inside the accommodating bag.

In contrast to the prior art, the present invention utilizes detachable connection of the third connecting component and the first connecting component and detachable connection of the fourth connecting component and the second connecting component to connect the vest and the back strap, which is convenient in use and suitable for an older baby. Furthermore, the sleeping bag can be further connected to the vest by the fourth connecting component or to the back strap by the eighth connecting component, so as to provide better support for a newborn baby. Therefore, the present invention provides a flexible way to carry a baby of different ages comfortably and safely.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
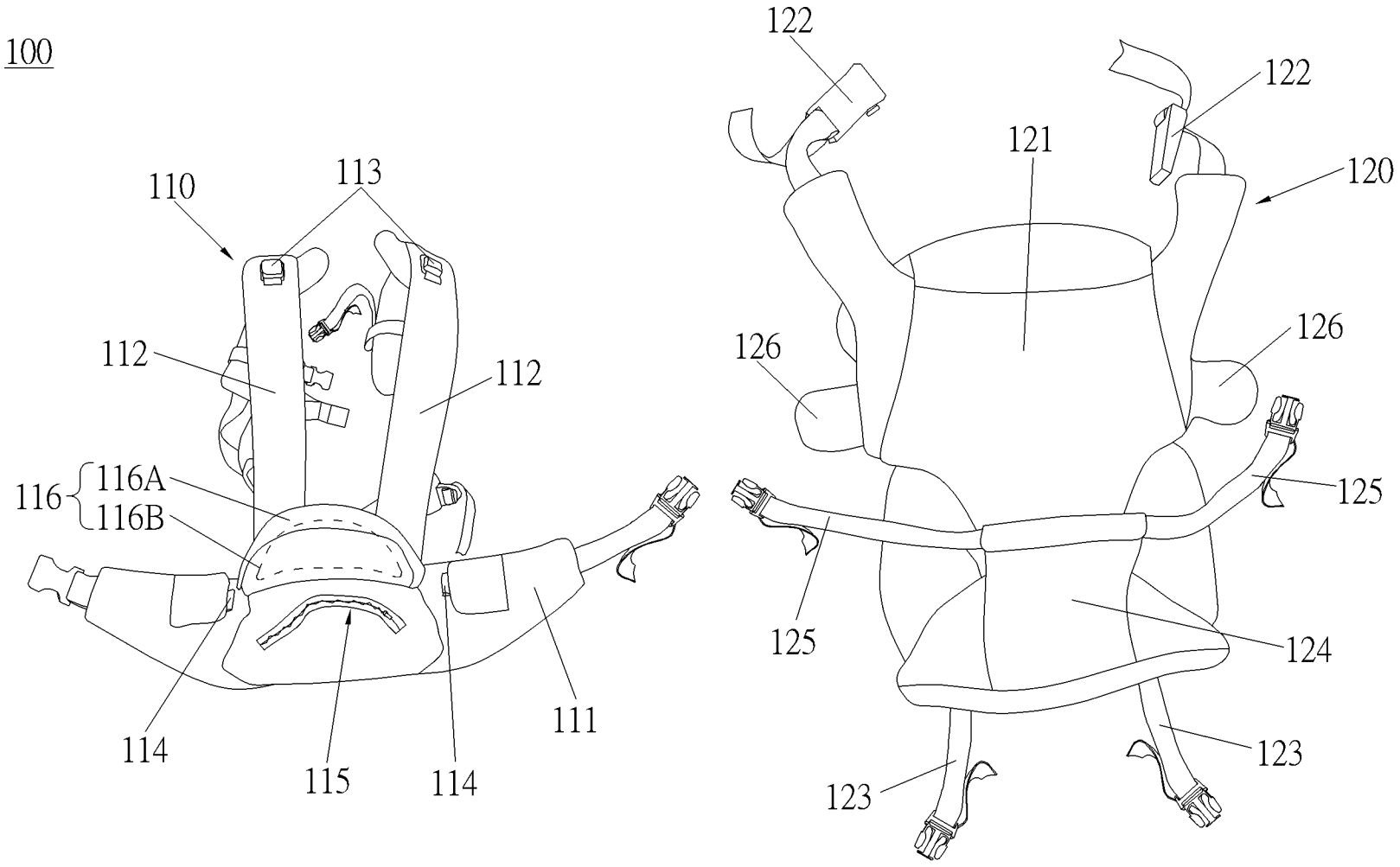
FIG. 1 is a schematic diagram of a baby carrier according to a first embodiment of the present invention.

In order to illustrate technical specifications and structural features as well as achieved purposes and effects of the present invention, relevant embodiments and figures are described as follows. In addition, to simplify the descriptions and make it more convenient to compare between each embodiment, identical components are marked with the same reference numerals in each of the following embodiments. Please note that the figures are only for illustration and the figures may not be to scale.

Figure 2:
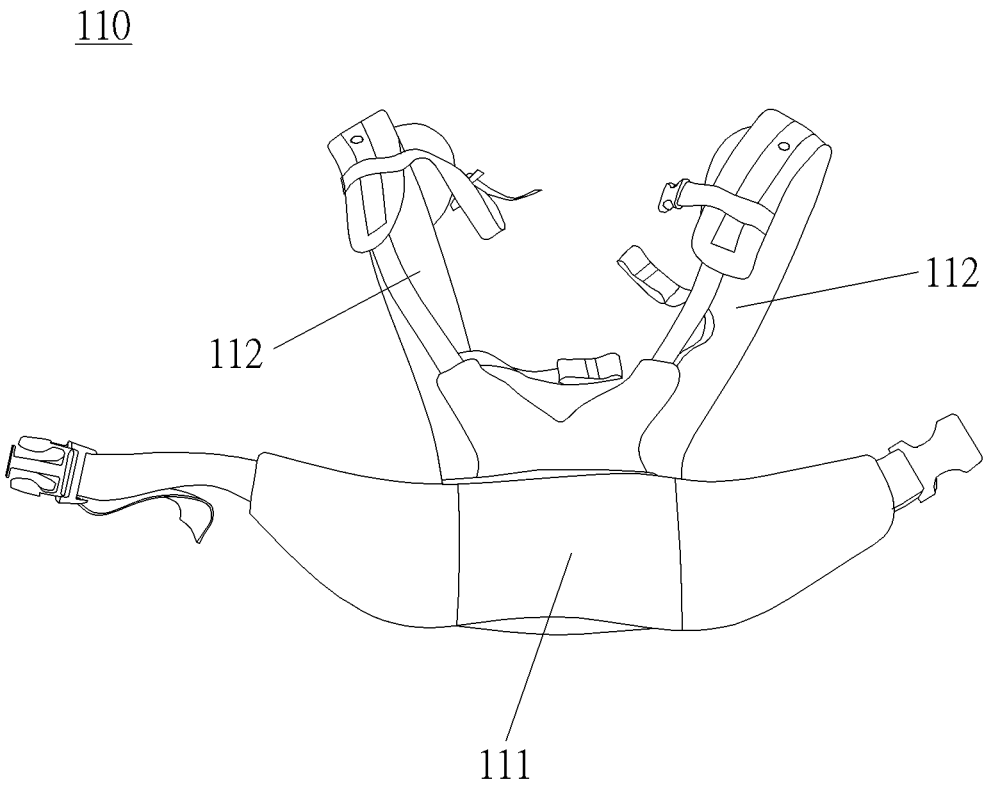
FIG. 2 is a diagram of a back strap according to the first embodiment of the present invention.
Figure 3:
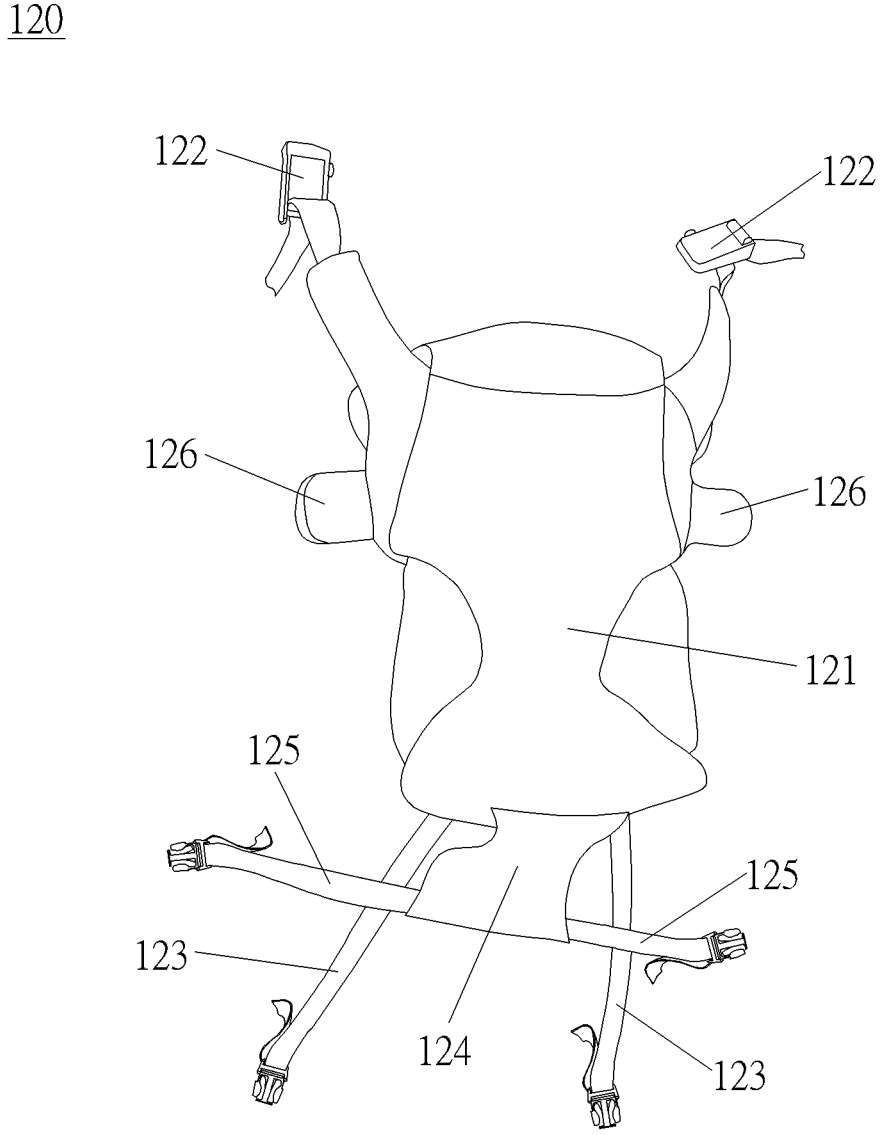
FIG. 3 is a diagram of a vest according to the first embodiment of the present invention.
Figure 4:
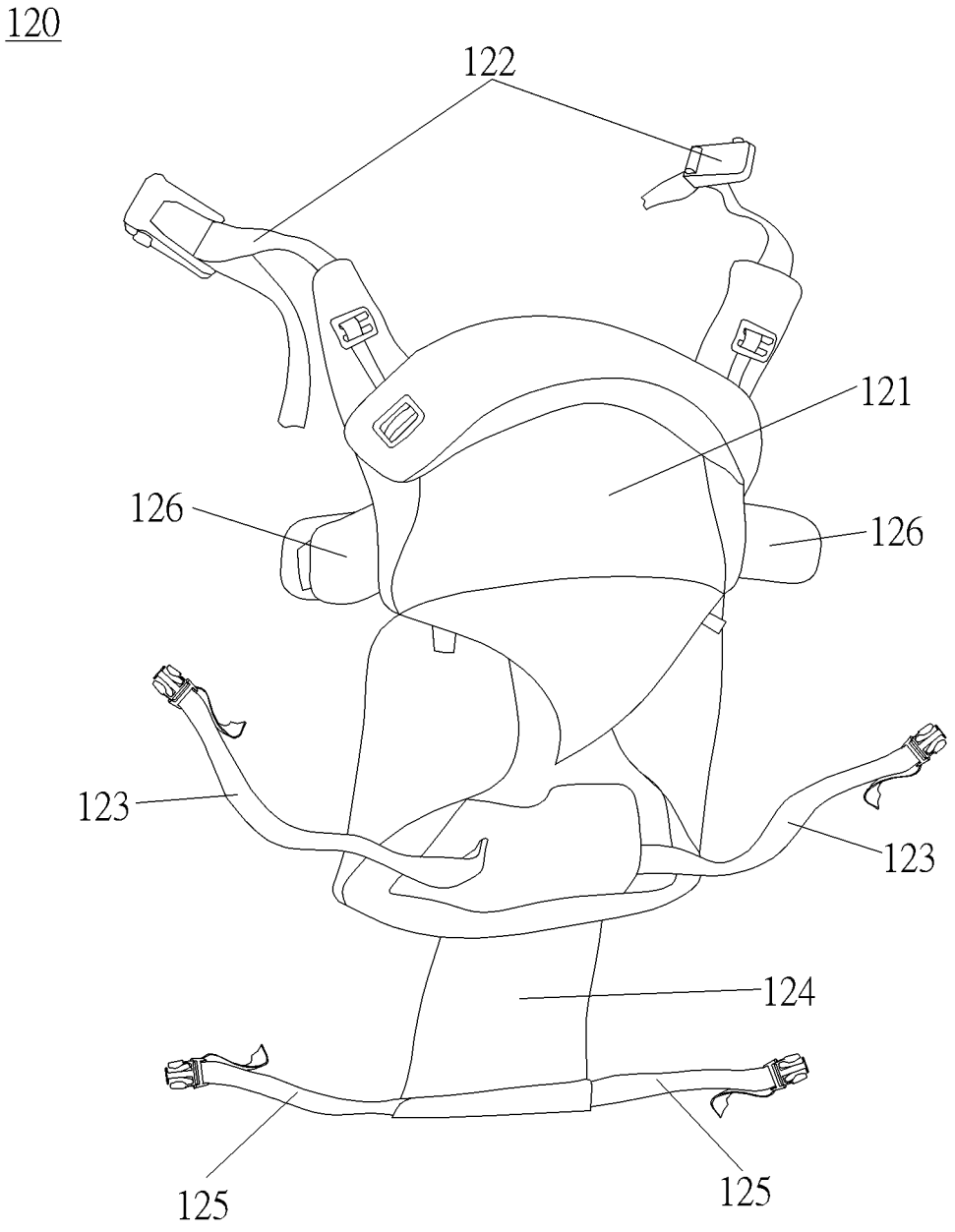
FIG. 4 is a diagram of the vest at another view according to the first embodiment of the present invention.

Please refer to FIG. 1 to FIG. 4. FIG. 1 is a schematic diagram of a baby carrier 100 according to a first embodiment of the present invention. FIG. 2 is a diagram of a back strap 110 according to the first embodiment of the present invention. FIG. 3 is a diagram of a vest 120 according to the first embodiment of the present invention. FIG. 4 is a diagram of the vest 120 at another view according to the first embodiment of the present invention. As shown in FIG. 1 to FIG. 4, in the first embodiment, the baby carrier 100 includes the back strap 110 and the vest 120. The back strap 110 includes a waist belt 111, two shoulder straps 112, two first connecting components 113, two second connecting components 114 and a receiving bag 115. The two shoulder straps 112 are connected to the waist belt 111. Each of the two first connecting components 113 is disposed on the corresponding shoulder strap 112. The two second connecting components are disposed on the waist belt 111. The receiving bag 115 is disposed on the waist belt 111 and located between the two second connecting components 114. The vest 120 is detachably connected to the back strap 110 by the two first connecting components 113 and the two second connecting components 114.

Furthermore, the vest 120 includes a vest body 121, two third connecting components 122 and two fourth connecting components 123. The vest body 121 can be used for supporting a baby. The two third connecting components 122 and the two fourth connecting components 123 are respectively disposed on two ends of the vest body 121 and arranged along a longitudinal direction of the vest body 121. Specifically, the two third connecting components 122 are symmetrically disposed on an upper end of the vest body 121, and the two fourth connecting components 123 are symmetrically disposed on a lower end of the vest body 121. The two third connecting components 122 and the two fourth connecting components 123 are respectively detachably connected to the two first connecting components 113 and the two second connecting components 114, so as to detachably connect the vest 120 to the back strap 110, which ensures connection stability and load balance of the vest 120 and the back strap 110.

As shown in FIG. 3 and FIG. 4, the vest 120 further includes a first fixing component 124, two fifth connecting components 125 and two sixth connecting components 126. An end of the first fixing component 124 is connected to an end of the vest body 121 adjacent to the two fourth connecting components 123. The two fifth connecting components 125 are fixed on another end of the first fixing component 124 away from the vest body 121. The two sixth connecting components 126 are substantially disposed on a middle portion of the vest body 121 and located between the two third connecting components 122 and the two fourth connecting components 123. After the first fixing component 124 is folded relative to the vest body 121, the two fifth connecting components 125 can be detachably connected to the two sixth connecting components 126 to restrain the baby by the first fixing component 124.

In this embodiment, the first connecting component 113 and the third connecting component 122, the second connecting component 114 and the fourth connecting component 123, and the fifth connecting component 125 and the sixth connecting component can be connected to each other by buckle components. However, it is not limited thereto. For example, in another embodiment, the first connecting component 113 and the third connecting component 122, the second connecting component 114 and the fourth connecting component 123, and the fifth connecting component 125 and the sixth connecting component can be connected to each other by zippers or velcro tapes.

As shown in FIG. 1, the back strap 110 further includes a hip seat 116 connected to the waist belt 111 and for allowing the baby to sit thereon. The hip seat 116 is disposed above the receiving bag 115 and located between the two second connecting components 114. It provides comfortable sitting feeling for the baby due to support of the hip seat 116 when the baby sits in the baby carrier 100.

Specifically, the hip seat 116 includes an accommodating bag 116A connected to the waist belt 111 and a seat core 116B accommodated inside the accommodating bag 116A. The seat core 116B can be an integrally formed structure and made of Hytrel, polypropylene (PP), expanded polypropylene (EPP), acrylonitrile butadiene styrene (ABS), or fiberboard to provide better support, elasticity and breathability. However, it is not limited thereto. The seat core 116B can be made of other materials.

As shown in FIG. 1 to FIG. 4, when it is desired to carry the baby by the baby carrier 100, the baby can be placed on the vest body 121. Afterwards, the first fixing component 124 can be folded relative to the vest body 121 to cover the baby's body, so that the baby can be restrained properly by the first fixing component 124 and the vest body 121 when the two fifth connecting components 125 are respectively connected to the two sixth connecting components 126. Furthermore, the two third connecting components 122 and the two fourth connecting components 123 can be respectively connected to the two first connecting components 113 and the two second connecting components 114 to connect the vest 120 to the back strap 110. Therefore, such configuration reduces a caregiver's burden and keeps the caregiver's hands free to interact with the baby when the caregiver carries the baby by the baby carrier 100 with the vest 120 connected to the back strap 110, which is convenient in use. The baby carrier 100 of this embodiment is mostly suitable for an older baby, who can be 4 months of age and above for example.

Furthermore, the baby can sit on the hip seat 16 when the baby is restrained by the first fixing component 124 and the vest body 121. The hip seat 116 can provide better support for the baby and make the baby more comfortable. However, it is not required to connect the vest 120 and the back strap 110 at all times. In other words, the back strap 110 of this embodiment can be used independently by support of the hip seat 16, which provides a flexible way to carry the baby.

Figure 5:
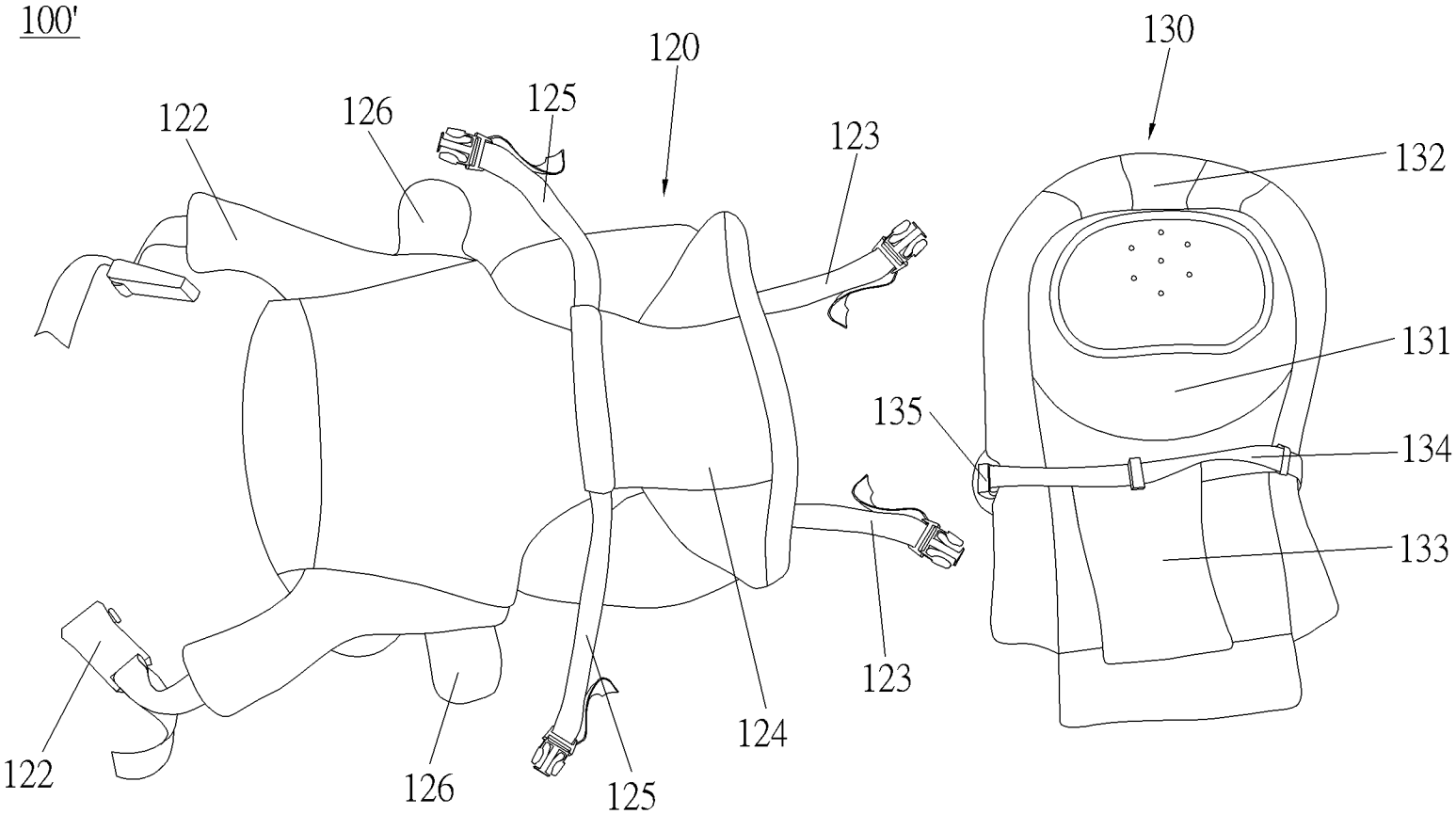
FIG. 5 is a schematic diagram of a vest and a sleeping bag of a baby carrier according to a second embodiment of the present invention.
Figure 6:
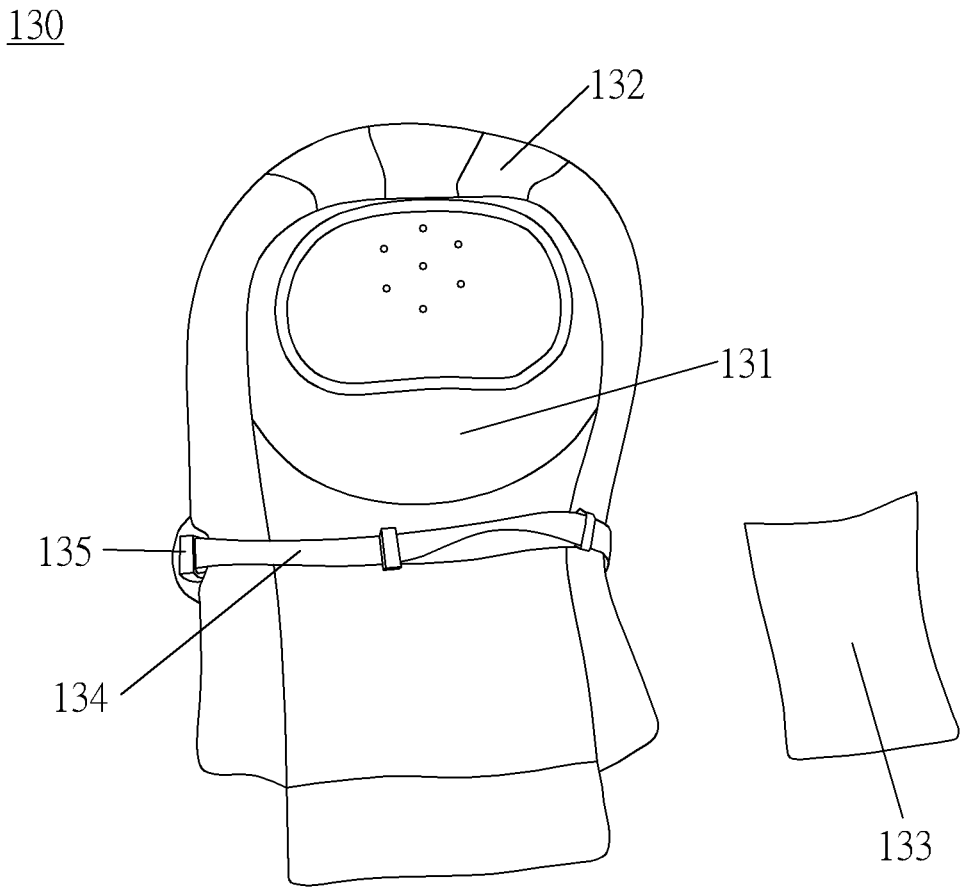
FIG. 6 is a diagram of the sleeping bag according to the second embodiment of the present invention.
Figure 7:
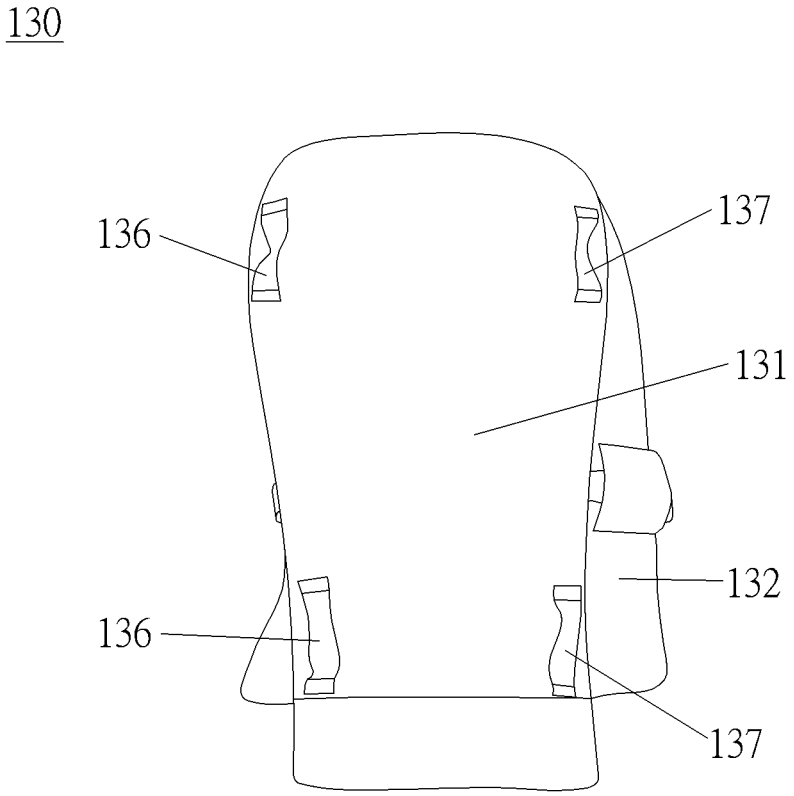
FIG. 7 is a diagram of the sleeping bag at another view according to the second embodiment of the present invention.
Figure 8:
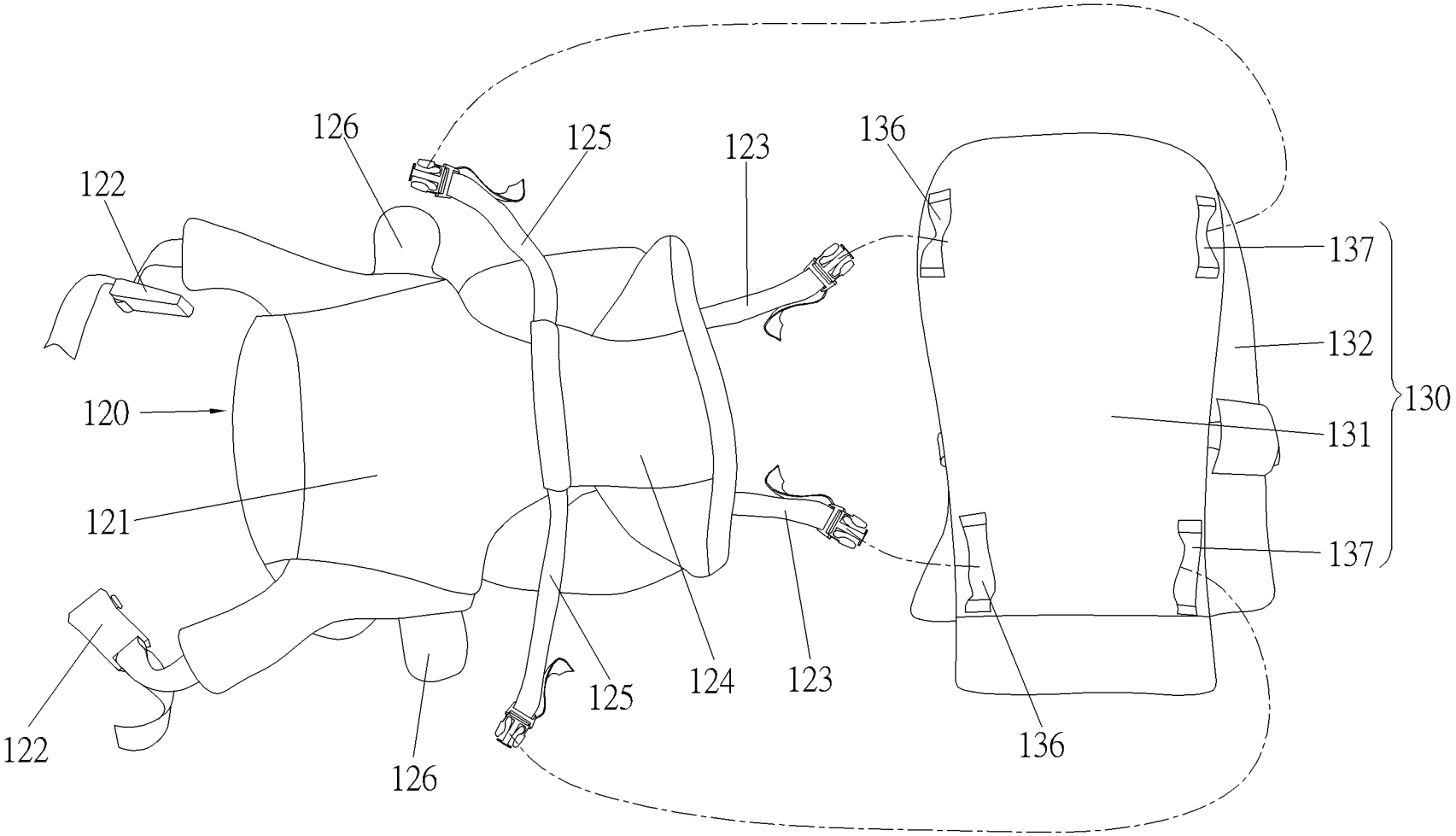
FIG. 8 is a diagram illustrating that the sleeping bag has not yet been completely connected to the vest according to the second embodiment of the present invention.
Figure 9:
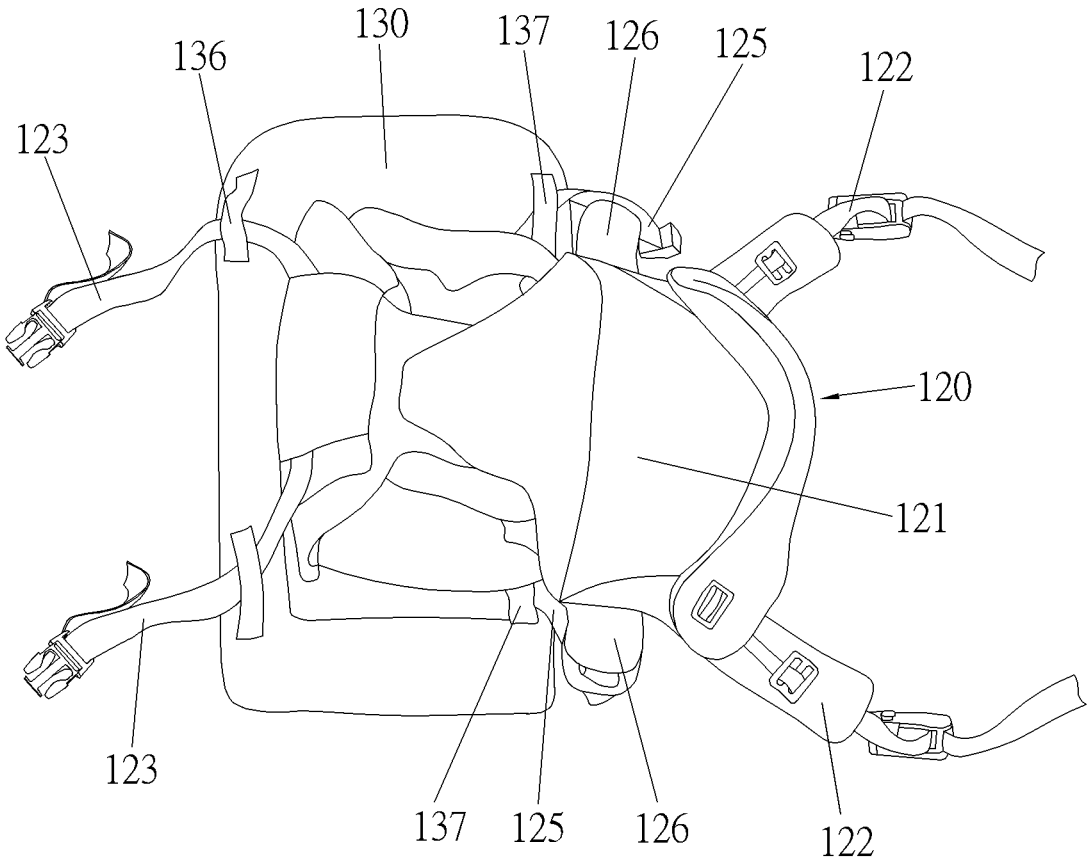
FIG. 9 is a diagram illustrating that the sleeping bag has been completely connected to the vest according to the second embodiment of the present invention.
Figure 10:
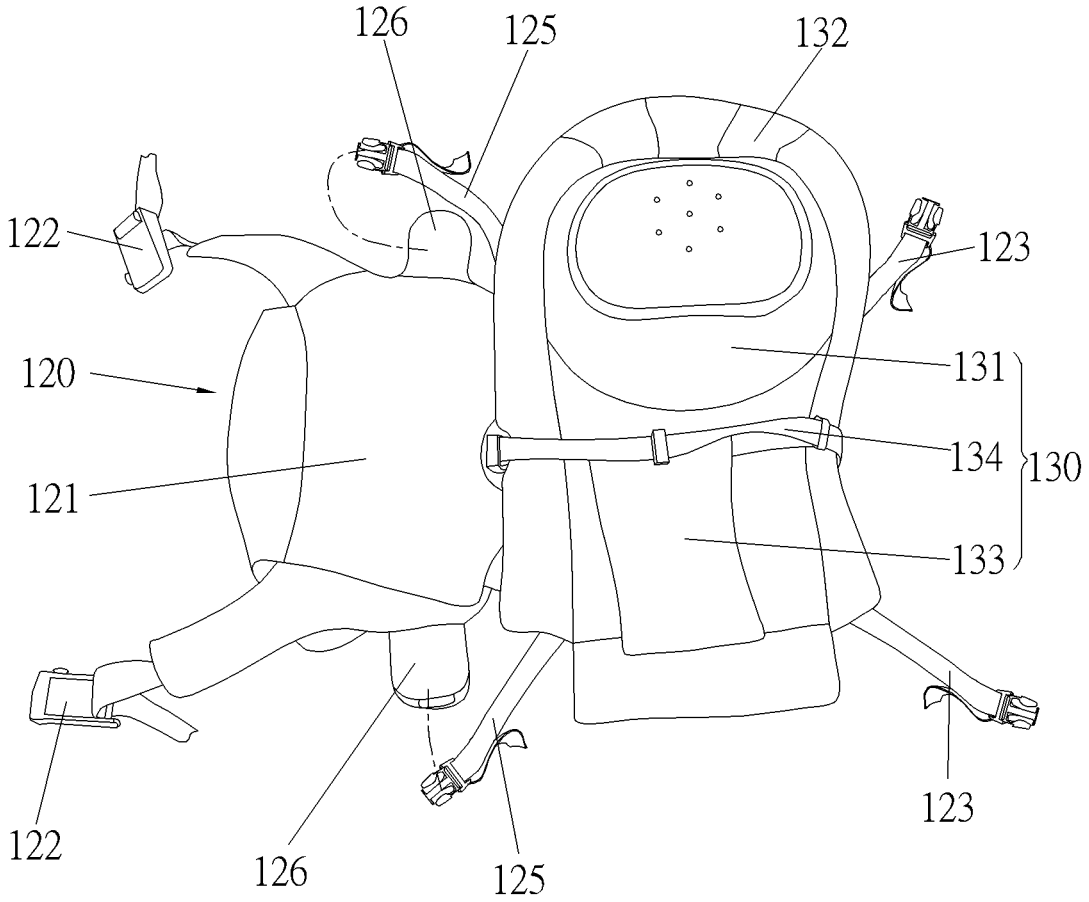
FIG. 10 is a diagram illustrating that the sleeping bag has been completely connected to the vest at another view according to the second embodiment of the present invention.

Please refer to FIG. 1 and FIG. 5 to FIG. 10. FIG. 5 is a schematic diagram of a vest 120 and a sleeping bag 130 of a baby carrier 100' according to a second embodiment of the present invention. FIG. 6 is a diagram of the sleeping bag 130 according to the second embodiment of the present invention. FIG. 7 is a diagram of the sleeping bag 130 at another view according to the second embodiment of the present invention. FIG. 8 is a diagram illustrating that the sleeping bag 130 has not yet been completely connected to the vest 120 according to the second embodiment of the present invention. FIG. 9 is a diagram illustrating that the sleeping bag 130 has been completely connected to the vest 120 according to the second embodiment of the present invention. FIG. 10 is a diagram illustrating that the sleeping bag 130 has been completely connected to the vest 120 at another view according to the second embodiment of the present invention. As shown in FIG. 1 and FIG. 5 to FIG. 10, the baby carrier 100' of this embodiment includes the back strap 110, the vest 120 and the sleeping bag 130. The sleeping bag 130 is detachably connected to the vest 120. The vest 120 is detachably connected to the back strap 110. The sleeping bag 130 is mostly suitable for a newborn baby. Structures of the back strap 110 and the vest 120 of this embodiment are the same as structures of the back strap 110 and the vest 120 of the first embodiment. Detailed description is omitted herein for simplicity. Detailed description for structure of the sleeping bag 130 and connection of the sleeping bag 130 and the vest 120 is described as follows.

As shown in FIG. 5 to FIG. 7, the sleeping bag 130 includes a supporting body 131, a surrounding border 132 and a second fixing component 133. The surrounding border 132 protrudes from a periphery of the supporting body 131. The second fixing component 133 is connected to the supporting body 131. A sitting area is formed between the supporting body 131 and the surrounding border 132. The second fixing component 133 is detachably connected to the supporting body 131 for fixing the baby.

In this embodiment, the sleeping bag 130 further includes a fixing strap 134 movably passing through the second fixing component 133. In this embodiment, an end of the fixing strap 134 can be fixed on the surrounding border 132, and another end of the fixing strap 134 can be detachably connected to the surrounding border 132 by a buckle component 135 for fixing the baby. However, it is not limited to this embodiment. For example, in another embodiment, the two ends of the fixing strap 134 can be detachably connected to the supporting body 131 by the zippers or the velcro tapes.

As shown in FIG. 7, the sleeping bag 130 further includes two first fixing rings 136 and two second fixing rings 137. The two first fixing rings 136 and the two second fixing rings 137 are disposed on a rear side of the supporting body 131 and respectively corresponding to the two fourth connecting components 123 and the two fifth connecting components 125. In this embodiment, the two first fixing rings 136 can be disposed on a lateral side of the sleeping bag 130, i.e., a left side of the sleeping bag 130 shown in FIG. 7, at an interval and arranged along a longitudinal direction of the sleeping bag 130, and the two second fixing rings 137 can be disposed on another lateral side of the sleeping bag 130, i.e., a right side of the sleeping bag 130 shown in FIG. 7, at an interval and arranged along the longitudinal direction of the sleeping bag 130. However, the numbers and the configuration of the first fixing ring 136 and the second fixing ring 137 are not limited to this embodiment.

As shown in FIG. 5 and FIG. 8 to FIG. 10, when it is desired to carry the baby by the baby carrier 100' of this embodiment, the first fixing component 124 of the vest 120 can be folded relative to the vest body 121 to locate each of the two fifth connecting components 125 between the corresponding third connecting component 122 and the corresponding fourth connecting component 123. Afterwards, the sleeping bag 130 can be placed on the vest body 121. At this moment, the longitudinal direction of the sleeping bag 130 is substantially perpendicular to the longitudinal direction of the vest body 121. The two fourth connecting components 123 can pass through the two first fixing rings 136 to wrap the rear side of the supporting body 131 of the sleeping bag 130 to connect with the two second connecting components 114 on the waist belt 111. At this moment, the two fourth connecting components 123 are arranged along a transverse direction of the sleeping bag 130. Correspondingly, the two fifth connecting components 125 can pass through the two second fixing rings 137 to wrap the rear side of the supporting body 131 of the sleeping bag 130 to connect with the two sixth connecting components 126. At this moment, the two fifth connecting components 125 are also arranged along the transverse direction of the sleeping bag 130, but extending directions of the two fifth connecting components 125 are opposite to extending directions of the two fourth connecting components 123. The two fourth connecting components 123 and the two fifth connecting components 125 are arranged along the transverse direction of the sleeping bag 130 to support the sleeping bag 130, so as to improve balance and stability of the sleeping bag 130. However, it is not limited to this embodiment. For example, in another embodiment, the two fourth connecting components 123 and the two fifth connecting components 125 also can respectively pass through the two second fixing rings 137 and the two first fixing rings 136. It depends on practical demands.

After completion of assembly of the sleeping bag 130 and the vest 120, the two third connecting components 122 and the two fifth connecting components 125 of the vest 120 can be connected to the two first connecting components 113 on the two shoulder straps 112 and the two second connecting components 114 on the waist belt 111 to complete assembly of the baby carrier 100' of this embodiment. At this moment, the longitudinal direction of the sleeping bag 130 extends along a horizontal direction, which facilitates the caregiver to hold the baby horizontally. Furthermore, the sleeping bag 130 can allow the baby to lie thereon to provide better support for the baby for improving comfort and safety. Therefore, the baby carrier 100' of this embodiment is mostly suitable for a newborn baby, who is below 4 months of age for example.

Figure 11:
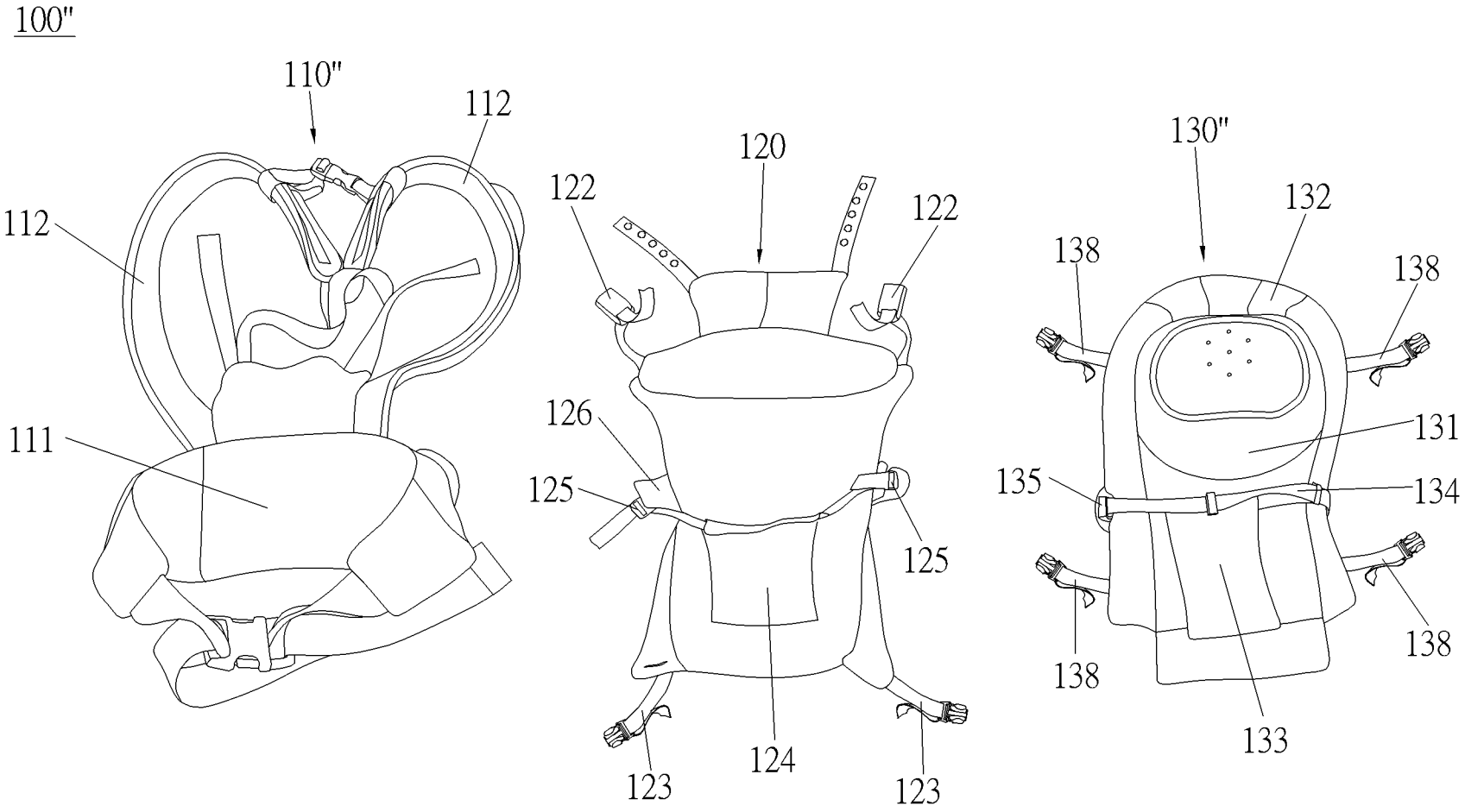
FIG. 11 is a schematic diagram of a baby carrier according to a third embodiment of the present invention.
Figure 12:
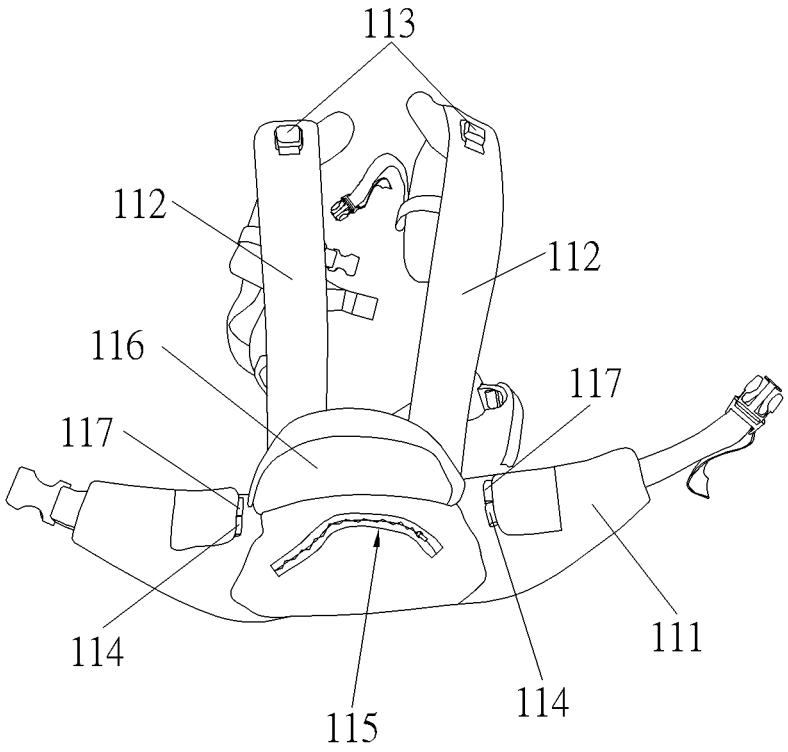
FIG. 12 is a diagram of a back strap according to the third embodiment of the present invention.
Figure 13:
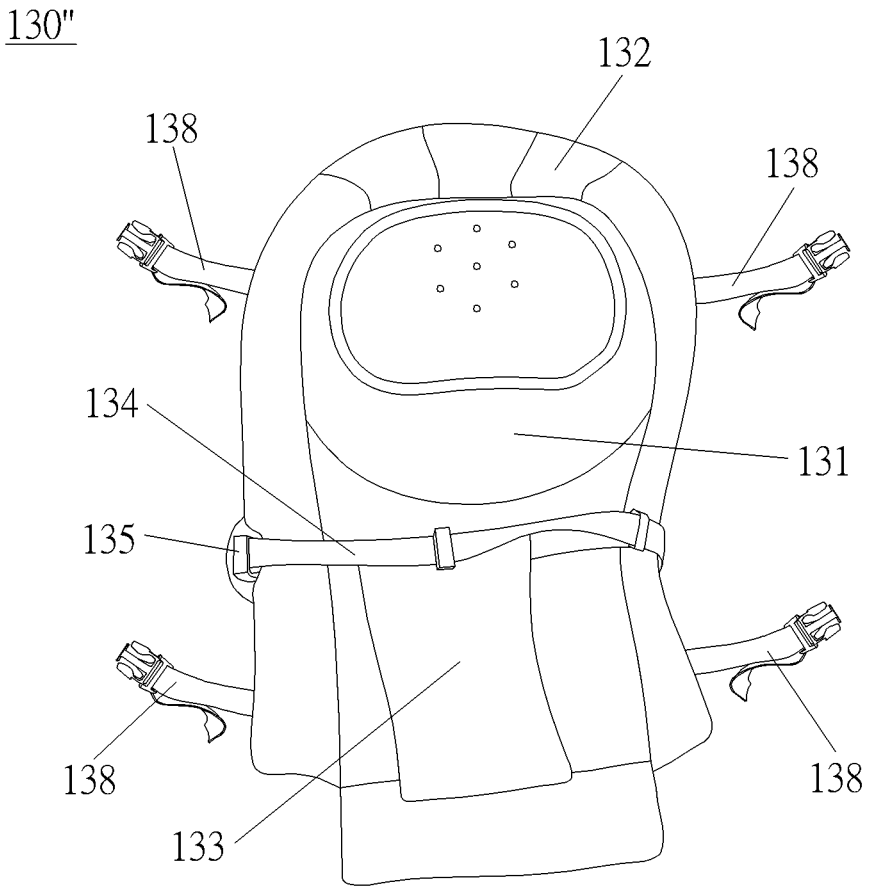
FIG. 13 is a diagram of a sleeping bag according to the third embodiment of the present invention.
Figure 14:
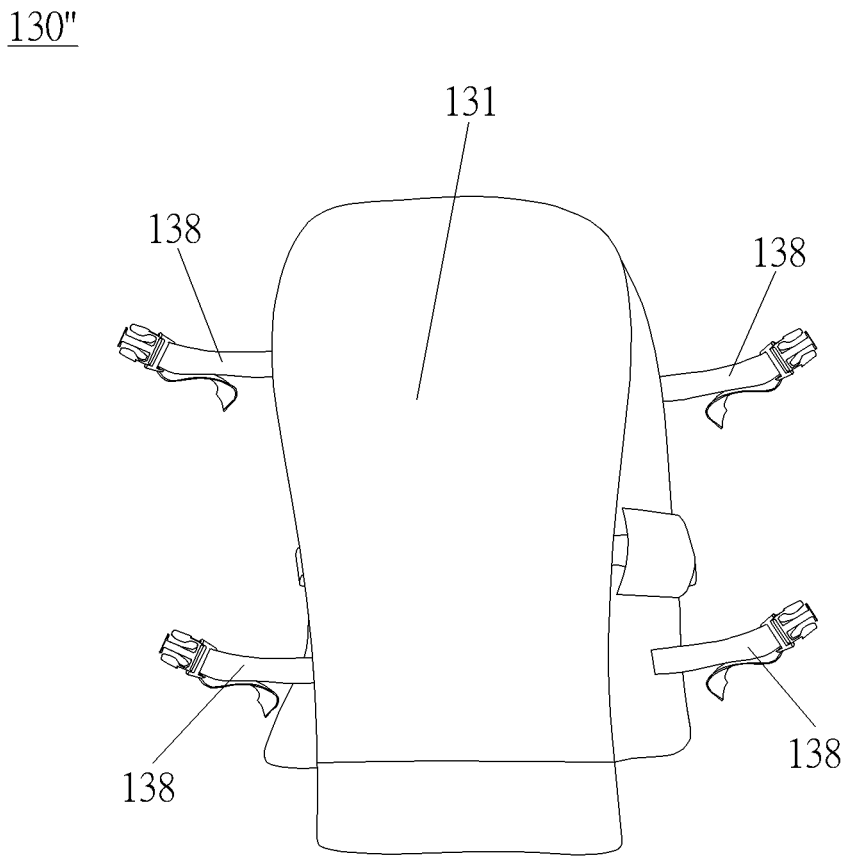
FIG. 14 is a diagram of the sleeping bag at another view according to the third embodiment of the present invention.
Figure 15:
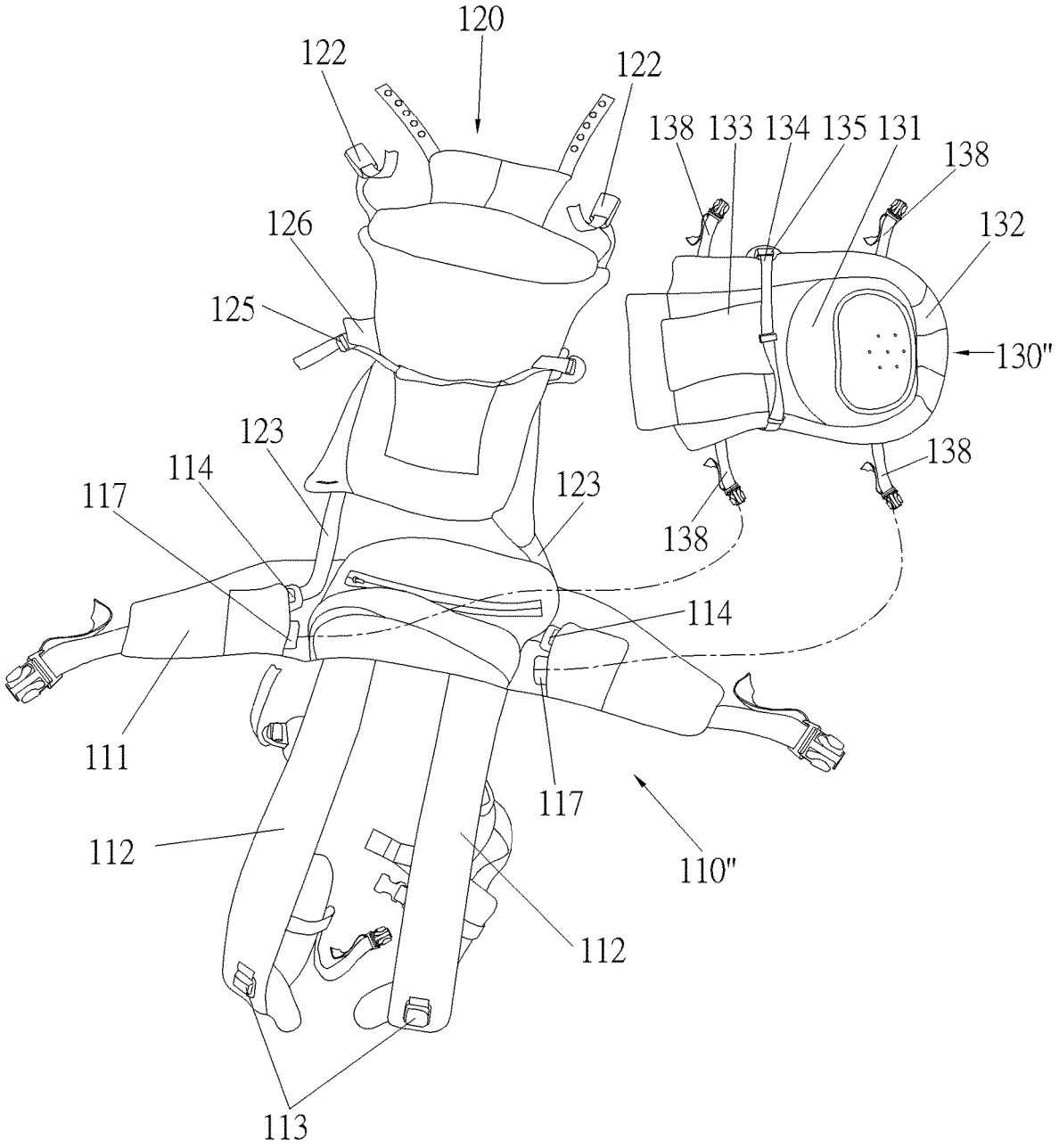
FIG. 15 is a diagram illustrating that the sleeping bag has not yet been connected to the back strap connected to the vest according to the third embodiment of the present invention.

Please refer to FIG. 11 to FIG. 15. FIG. 11 is a schematic diagram of the baby carrier 100" according to a third embodiment of the present invention. FIG. 12 is a diagram of a back strap 110" according to the third embodiment of the present invention. FIG. 13 is a diagram of a sleeping bag 130" according to the third embodiment of the present invention. FIG. 14 is a diagram of the sleeping bag 130" at another view according to the third embodiment of the present invention. FIG. 15 is a diagram illustrating that the sleeping bag 130" has not yet been connected to the back strap 110" connected to the vest 120 according to the third embodiment of the present invention. As shown in FIG. 11 to FIG. 15, in this embodiment, the baby carrier 100" includes the back strap 110", the vest 120 and the sleeping bag 130". The sleeping bag 130 is detachably connected to the back strap 110". The vest 120 is detachably connected to the back strap 110". The sleeping bag 130" can be restrained by the back strap 110" and the vest 120 for supporting the newborn baby. Structure of the vest 120 of this embodiment is similar to structure of the vests 120 of the aforementioned embodiments. Detailed description is omitted herein for simplicity.

Different from the aforementioned embodiments, the back strap 110" of this embodiment further includes two seventh connecting components 117 substantially parallel to the two second connecting components 114 and for detachably connecting with the sleeping bag 130". The sleeping bag 130" of this embodiment includes four eighth connecting components 138 but does not include the first fixing ring 136 and the second fixing ring 137 of the second embodiment. Two of the four eighth connecting components 138 are disposed on a lateral side of the sleeping bag 130" at an interval, and the other two of the four eighth connecting components 138 are disposed on another lateral side of the sleeping bag 130" at an interval, which allows the caregiver to connect any two of the four eighth connecting components 138 located at the same side to the corresponding seventh connecting components 117 to adjust an orientation of the sleeping bag 130". Furthermore, the four eighth connecting components 138 can be fixed on the supporting body 131 or the surrounding border 132. However, the number and configuration of the eighth connecting component are not limited to this embodiment. For example, in another embodiment, the sleeping bag 130" also can include two eighth connecting components 138 located at one lateral side of the sleeping bag 130" at an interval. It depends on practical demands.

As shown in FIG. 10 to FIG. 15, when it is desired to carry the baby by the baby carrier 100" of this embodiment, the first fixing component 124 of the vest 120 can be folded relative to the vest body 121 to locate each of the two fifth connecting components between the corresponding third connecting component 122 and the corresponding fourth connecting component 123. Afterwards, the sleeping bag 130" can be placed on the vest body 121. At this moment, the longitudinal direction of the sleeping bag 130" is interlaced, such as substantially perpendicular, to the longitudinal direction of the vest body 121, and the two eighth connecting components 138 are ready to be connected to the corresponding seventh connecting components 117 on the waist belt 111.

Furthermore, as shown in the FIG. 11 and FIG. 15, the two third connecting components 122 and the two fourth connecting components 123 of the vest 120 can be respectively connected to the two first connecting components 113 on the two shoulder straps 112 and the two second connecting components 114 on the waist belt 111 to connect the vest 120 to the back strap 110". Afterwards, the two eighth connecting components 138 can be connected to the corresponding seventh connecting components 117 on the waist belt 111 to connect the sleeping bag 130" to the back strap 110", which completes assembly of the baby carrier 100" of this embodiment. At this moment, the longitudinal direction of the sleeping bag 130" substantially extends along the horizontal direction, which facilitates the caregiver to hold the baby horizontally. Furthermore, the sleeping bag 130" can allow the baby to lie thereon to provide better support for the baby for improving comfort and safety. Therefore, the baby carrier 100" of this embodiment is mostly suitable for a newborn baby, who is below 4 months of age for example.

Preferably, in this embodiment, the seventh connecting component 117 and the eighth connecting component 118 can be detachably connected to each other by buckle components. However, it is not limited thereto. The seventh connecting component 117 and the eighth connecting component 118 can detachably connected to each other by the zippers or the velcro tapes.

In contrast to the prior art, the present invention utilizes detachable connection of the third connecting component and the first connecting component and detachable connection of the fourth connecting component and the second connecting component to connect the vest and the back strap, which is convenient in use and suitable for an older baby. Furthermore, the sleeping bag can be further connected to the vest by the fourth connecting component or to the back strap by the eighth connecting component, so as to provide better support for a newborn baby. Therefore, the present invention provides a flexible way to carry a baby of different ages comfortably and safely.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A baby carrier for carrying a baby, the baby carrier comprising:

a sleeping bag;

a back strap comprising at least one first connecting component and at least one second connecting component; and a vest comprising a vest body, at least one third connecting component, at least one fourth connecting component and at least one fifth connecting component, the at least one third connecting component and the at least one fourth connecting component being respectively fixed on two ends of the vest body, the at least one third connecting component being detachably connected to the at least one first connecting component, and the at least one fourth connecting component being for detachably connecting the sleeping bag to the vest or detachably connecting the vest to the back strap, the at least one fifth connecting component being disposed on the vest body and located between the at least one third connecting component and the at least one fourth connecting component, the at least one fifth connecting component passing through the sleeping bag to be detachably connected to the at least one second connecting component, and the at least one fourth connecting component passing through the sleeping bag to be detachably connected to the vest body.

2. The baby carrier of claim 1, wherein vest further comprises at least one sixth connecting component disposed on the vest body and located between the at least one third connecting component and the at least one fifth connecting component, and the at least one fifth connecting component is detachably connected to the at least one sixth connecting component.

3. The baby carrier of claim 1, wherein the sleeping bag comprises a supporting body, at least one first fixing ring and at least one second fixing ring, the at least one first fixing ring and the at least one second fixing ring are symmetrically disposed on a rear side of the supporting body, the at least one fourth connecting component passes through the at least one first fixing ring, and the at least one fifth connecting component passes through the at least one second fixing ring.

4. The baby carrier of claim 1, wherein the vest further comprises a first fixing component connected to an end of the vest body, and the at least one fifth connecting component is fixed on an end of the first fixing component away from the vest body.

5. The baby carrier of claim 1, wherein the back strap further comprises at least one seventh connecting component, the sleeping bag comprises at least one eighth connecting component corresponding to the at least one seventh connecting component, the vest body is for supporting the sleeping bag, the at least one seventh connecting component is detachably connected to the at least one eighth connecting component to connect the sleeping bag to the back strap, and the at least one fourth connecting component is detachably connected to the at least one second connecting component to connect the vest to the back strap.

6. The baby carrier of claim 1, wherein the at least one third connecting component and the at least one fourth connecting component are respectively disposed on two ends of the vest body and arranged along a longitudinal direction of the vest body, and the longitudinal direction of the vest body is perpendicular to a longitudinal direction of the sleeping bag.

7. The baby carrier of claim 1, wherein the sleeping bag comprises a supporting body and a surrounding border disposed on a periphery of the supporting body.

8. The baby carrier of claim 7, wherein the sleeping bag further comprises a second fixing component detachably connected to an end of the supporting body and for fixing the baby.

9. The baby carrier of claim 8, wherein the sleeping bag further comprises a fixing strap movably passing through the second fixing component, and at least one end of the fixing strap is detachably connected to the supporting body or the surrounding border.

10. The baby carrier of claim 1, wherein the back strap further comprises a waist belt and two shoulder straps connected to the waist belt, the at least one first connecting component is disposed on at least one of the two shoulder straps, and the at least one second connecting component is disposed on the waist belt.

11. The baby carrier of claim 10, wherein the back strap further comprises a hip seat connected to the waist belt and for supporting the baby.

12. The baby carrier of claim 11, wherein the hip seat comprises an accommodating bag and a seat core accommodated inside the accommodating bag.

13. A baby carrier for carrying a baby, the baby carrier comprising:

a sleeping bag comprising a supporting body, a surrounding border and a second fixing component, the surrounding border being disposed on a periphery of the supporting body, and the second fixing component being detachably connected to an end of the supporting body and for fixing the baby;

a back strap comprising at least one first connecting component and at least one second connecting component; and a vest comprising a vest body, at least one third connecting component and at least one fourth connecting component, the at least one third connecting component and the at least one fourth connecting component being respectively fixed on two ends of the vest body, the at least one third connecting component being detachably connected to the at least one first connecting component, and the at least one fourth connecting component being for detachably connecting the sleeping bag to the vest or detachably connecting the vest to the back strap.

14. The baby carrier of claim 13, wherein the back strap further comprises at least one seventh connecting component, the sleeping bag comprises at least one eighth connecting component corresponding to the at least one seventh connecting component, the vest body is for supporting the sleeping bag, the at least one seventh connecting component is detachably connected to the at least one eighth connecting component to connect the sleeping bag to the back strap, and the at least one fourth connecting component is detachably connected to the at least one second connecting component to connect the vest to the back strap.

15. The baby carrier of claim 13, wherein the at least one third connecting component and the at least one fourth connecting component are respectively disposed on two ends of the vest body and arranged along a longitudinal direction of the vest body, and the longitudinal direction of the vest body is perpendicular to a longitudinal direction of the sleeping bag.

16. The baby carrier of claim 13, wherein the sleeping bag further comprises a fixing strap movably passing through the second fixing component, and at least one end of the fixing strap is detachably connected to the supporting body or the surrounding border.

17. The baby carrier of claim 13, wherein the back strap further comprises a waist belt and two shoulder straps connected to the waist belt, the at least one first connecting component is disposed on at least one of the two shoulder straps, and the at least one second connecting component is disposed on the waist belt.

18. The baby carrier of claim 17, wherein the back strap further comprises a hip seat connected to the waist belt and for supporting the baby.

19. The baby carrier of claim 18, wherein the hip seat comprises an accommodating bag and a seat core accommodated inside the accommodating bag.

* * * * *